US009589497B2

(12) United States Patent
Chen

(10) Patent No.: US 9,589,497 B2
(45) Date of Patent: Mar. 7, 2017

(54) METHODS OF GRAYSCALE CALIBRATION OF SUBPIXELS OF LIQUID CRYSTAL PANELS DURING IMAGING

(71) Applicant: Shenzhen China Star Optoelectronics Technology Co., Ltd., Shenzhen, Guangdong (CN)

(72) Inventor: Lixuan Chen, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 75 days.

(21) Appl. No.: 14/766,547

(22) PCT Filed: May 21, 2015

(86) PCT No.: PCT/CN2015/079512

§ 371 (c)(1),
(2) Date: Aug. 7, 2015

(87) PCT Pub. No.: WO2016/131216

PCT Pub. Date: Aug. 25, 2016

(65) Prior Publication Data

US 2016/0343289 A1 Nov. 24, 2016

(51) Int. Cl.
*G09G 3/20* (2006.01)
*G09G 3/36* (2006.01)

(52) U.S. Cl.
CPC ..... *G09G 3/2074* (2013.01); *G09G 3/2003* (2013.01); *G09G 3/2011* (2013.01);
(Continued)

(58) Field of Classification Search
CPC ..... G09G 3/3648; G09G 3/2074; G09G 2300/0443; G09G 2320/0233;
(Continued)

(56) References Cited

U.S. PATENT DOCUMENTS

2005/0041122 A1* 2/2005 Yamazaki ..... G09G 3/3648 348/254
2009/0309807 A1* 12/2009 Matsumoto ..... G06F 3/1431 345/1.1

(Continued)

FOREIGN PATENT DOCUMENTS

CN 104167194 A 11/2014

*Primary Examiner* — Gerald Johnson
(74) *Attorney, Agent, or Firm* — Andrew C. Cheng

(57) ABSTRACT

A method of grayscale calibration of subpixels of liquid crystal panels during imaging includes: obtaining a first brightness value when the subpixel of the i-th color has a maximum grayscale; calculating a second brightness value of each grayscale(j); obtaining a third brightness value of each grayscale(r) of the main subpixel area and a fourth brightness value of each grayscale (s) of the secondary subpixel area of under the direct view condition; determining value combinations for the main and the secondary subpixel area of the subpixel having the grayscale (j) and satisfying a predetermined criteria; calculating total color differences of the grayscale images respectively for the direct and a squint view condition when the value combination being applied; determining the value combination of the minimum total color difference as the value combination applied for the subpixel. With such configuration, the color shift of the liquid crystal panel may be reduced.

10 Claims, 3 Drawing Sheets

(52) U.S. Cl.
CPC ..... *G09G 3/36* (2013.01); *G09G 2300/0452* (2013.01); *G09G 2320/028* (2013.01); *G09G 2320/0242* (2013.01); *G09G 2320/0276* (2013.01); *G09G 2320/0673* (2013.01); *G09G 2320/0693* (2013.01); *G09G 2360/16* (2013.01)

(58) Field of Classification Search
CPC ..... G09G 3/3611; G09G 2320/0686; G09G 2340/16; G09G 2300/0452; G09G 2320/0242; G09G 2320/0276; G09G 2320/0673
See application file for complete search history.

(56) References Cited

U.S. PATENT DOCUMENTS

2013/0070006 A1* 3/2013 Yang ..... G09G 3/3225 345/694
2014/0146098 A1* 5/2014 Furihata ..... G09G 5/00 345/694
2016/0189671 A1* 6/2016 Kim ..... G09G 3/3291 345/690
2016/0335945 A1* 11/2016 Kang ..... G02F 1/133

* cited by examiner

METHODS OF GRAYSCALE CALIBRATION OF SUBPIXELS OF LIQUID CRYSTAL PANELS DURING IMAGING

BACKGROUND OF THE INVENTION

1. Field of the Invention

The present disclosure relates to liquid crystal display technology, and more particularly to a method of grayscale calibration of subpixels of liquid crystal panels during imaging.

2. Discussion of the Related Art

Recently, CRTs have been replaced gradually by LCDs due to the attributes of the LCDs, such as small volume, light weight, and high display performance. Images displayed by liquid crystal panels include a plurality of pixels arranged in a matrix. Each pixel includes subpixels for displaying various colors. The brightness of each of the subpixels is determined by the brightness of the backlight module of the LCDs and the grayscale of the subpixels of the liquid crystal panel. Currently, the most popular driving method of LCDs relates to maintaining certain brightness by the brightness of the backlight module. The liquid crystal molecules within each of the subpixels of the liquid crystal panel have been driven by voltage having different grayscale voltage in accordance with inputted image. In this way, the angle for which the liquid crystal molecules has been rotated may be adopted to determine the light transmission rate, i.e., brightness, of each of the sub-pixel so as to display the images.

With the development of the LCDs, there is an increasing demand toward better viewing angle of the LCDs. Thus, wide-viewing-angle LCDs, such as MVA LCD, have been developed. Such LCDs may adopts 2D1G technology to achieve the wide-viewing angle feature. As shown in FIG. 2, the subpixel 20 may be divided into a main subpixel area (M) and a secondary subpixel area (S). By applying data signals, i.e., grayscale voltage, toward the main subpixel area (M) and the secondary subpixel area (S), the subpixel 20 may display corresponding grayscale so as to display the images. However, color shift issue may occur for the wide-viewing-angle images displayed by the wide-viewing-angle LCDs.

SUMMARY

According to the present disclosure, the method of grayscale calibration of subpixels of liquid crystal panels during imaging is capable of reducing the color shift.

In one aspect, a method of grayscale calibration of subpixels of liquid crystal panels during imaging, each of the pixels of the liquid crystal panel comprises a plurality of subpixels of n number of colors, wherein n is an integer larger than 0, each of the subpixels comprises a main subpixel area and a secondary subpixel area, the method comprising: (a) measuring a Gamma curve of i-th color among n numbers of colors under a direct view condition to obtain a first brightness value when the subpixel of the i-th color has a maximum grayscale (m), wherein $i \in [1, n]$; (b) calculating a second brightness value L(j) corresponding to each of grayscale of the subpixel of the i-th color in accordance with the first brightness value and a predetermined Gamma value, wherein $j \in [t, m]$, t representing a minimum grayscale; (c) obtaining a third brightness value Lm(r) corresponding to each of the grayscale (r) of the main subpixel area of the subpixel of the i-th color is calculated under the direct view condition, wherein $r \in [t, m]$; (d) obtaining a fourth brightness value Ls(s) corresponding to each of the grayscale of the secondary pixel area of the subpixel of the i-th color under the direct view condition, wherein $s \in [t, m]$; (e) determining value combinations for the grayscale of the main subpixel area and the grayscale of the secondary subpixel area of the subpixel of the i-th color basing on the second brightness value L(j), and the third brightness value Lm(r) and the fourth brightness value Ls(s) corresponding to the j-th grayscale satisfying a predetermined criteria; (f) calculating total color differences of the grayscale images respectively for the direct view condition and a squint view condition for the subpixel of the i-th color having the grayscale (j) when the value combination being applied; and (g) determining the value combination corresponding to the minimum total color difference as the value combination applied for the subpixel of the i-th color having the grayscale (j).

Wherein the step (f) further comprises: (f1) obtaining tristimulus values of grayscale images displayed by the liquid crystal panel respectively when applying one of the value combination under a direct view condition and a squint view condition, wherein the subpixel of the i-th color having the grayscale (j); (f2) calculating psychrometric lightness and psychrometric chromaticity in accordance with the tristimulus values under the direct view condition, and calculating psychrometric lightness and psychrometric chromaticity in accordance with the tristimulus values under the squint view condition; and (f3) calculating the total color difference of the grayscale images respectively for the direct view condition and the squint view condition in accordance with the psychrometric lightness and psychrometric chromaticity under the direct view condition and the squint view condition.

Wherein the step (b) further comprises: calculating the second brightness value L(j) corresponding to each of the grayscale (j) of the subpixel of the i-th color in accordance with the first brightness value and the predetermined Gamma value by the equation: $L(j)=L(m)\times(j/m)^{\gamma}$; wherein $\gamma$ represents a predetermined Gamma value, and L(m) represents the first brightness value when the subpixel of the i-th color has a maximum grayscale (m).

Wherein the step (c) further comprises: turning off the secondary subpixel area of the subpixel of the i-th color; measuring the Gamma curve of the i-th color of the liquid crystal panel under the direct view condition so as to obtain the third brightness value Lm (R) corresponding to the r-th grayscale of the main subpixel area of the subpixels of the i-th color; and the step (d) further comprises: turning off the main subpixel area of the subpixel of the i-th color; and measuring the Gamma curve of the i-th color of the liquid crystal panel under the direct view condition so as to obtain the fourth brightness value Ls(s) corresponding to the s-th grayscale of the secondary subpixel area of the subpixels of the i-th color.

Wherein the predetermined criteria of the step (e) is: $[Lm(r)+Ls(s)-L(j)]/L(j)<S$; wherein S is the predetermined value.

In another aspect, a method of grayscale calibration of subpixels of liquid crystal panels during imaging, each of the pixels of the liquid crystal panel comprises a plurality of subpixels of n number of colors, wherein n is an integer larger than 0, each of the subpixels comprises a main subpixel area and a secondary subpixel area, the method comprising: (a) measuring a Gamma curve of i-th color among n numbers of colors under a direct view condition to obtain a first brightness value when the subpixel of the i-th color has a maximum grayscale (m), wherein $i \in [1, n]$; (b) calculating a second brightness value L(j) corresponding to each of grayscale of the subpixel of the i-th color in accordance with the first brightness value and a predetermined Gamma value, wherein j∈[t, m], t representing a minimum grayscale; (c) selecting at least one value combination of the grayscale (r) of the main subpixel area of the i-th color and the grayscale (s) of the secondary subpixel area of the i-th color, such that the total color difference of grayscale images of the liquid crystal panel between a direct view conditions and a squint view condition is smaller than a predetermined value, and r∈[t, m], s∈[t, m]; (d) calculating a third brightness value corresponding to the grayscale of the main subpixel area of the subpixel of the i-th color of the selected value combination under the direct view condition;

(e) calculating a fourth brightness value corresponding to the grayscale of the secondary pixel area of the subpixel of the i-th color of the selected value combination under the direct view condition; (f) determining whether the value combinations of the third brightness value and the fourth brightness value corresponding to the grayscale (j) satisfying the predetermined criteria in accordance with the second brightness value L(j); and (g) selecting the value combination of the subpixel of the i-th color having grayscale (j).

Wherein the step (c) further comprises: (c1) obtaining tristimulus values of grayscale images displayed by the liquid crystal panel respectively for a direct view condition and a squint view condition; (c2) calculating psychrometric lightness and psychrometric chromaticity in accordance with the tristimulus values under the direct view condition, and calculating psychrometric lightness and psychrometric chromaticity in accordance with the tristimulus values under the squint view condition; and (c3) calculating a total color difference of the grayscale images of the liquid crystal panel respectively for the direct view condition and the squint view condition in accordance with the psychrometric lightness and psychrometric chromaticity under the direct view condition and the squint view condition.

Wherein the step (b) further comprises: calculating the second brightness value L(j) corresponding to each of the grayscale (j) of the subpixel of the i-th color in accordance with the first brightness value and the predetermined Gamma value by the equation: $L(j)=L(m)\times(j/m)^{\gamma}$; wherein γ represents a predetermined Gamma value, and L(m) represents the first brightness value when the subpixel of the i-th color has a maximum grayscale (m).

Wherein the step (d) further comprises: turning off the secondary subpixel area of the subpixel of the i-th color; measuring the Gamma curve of the i-th color of the liquid crystal panel under the direct view condition so as to obtain the third brightness value corresponding to the grayscale of the main subpixel area of the subpixels of the i-th color of the selected value combination; wherein the step (e) further comprises: turning off the main subpixel area of the subpixel of the i-th color; and measuring the Gamma curve of the i-th color of the liquid crystal panel under the direct view condition so as to obtain the fourth brightness value corresponding to the grayscale of the secondary subpixel area of the subpixels of the i-th color of the selected value combination.

Wherein the predetermined criteria is selected such that the equation below owns the minimum value: [Lm(x)+Ls(y)−L(j)]/L(j); wherein Lm(x) represents a third brightness value corresponding to the grayscale (x) of the main subpixel area of the value combination, and Ls(y) represents a fourth brightness value corresponding to the grayscale (y) of the secondary subpixel area of the value combination.

In view of the above, the method of grayscale calibration of subpixels of liquid crystal panels during imaging is capable of calibrating the grayscale of the subpixel during imaging so as to reduce the color shift issue when displaying images.

DETAILED DESCRIPTION OF THE EMBODIMENTS

Embodiments of the invention will now be described more fully hereinafter with reference to the accompanying drawings, in which embodiments of the invention are shown.

Figure 1:
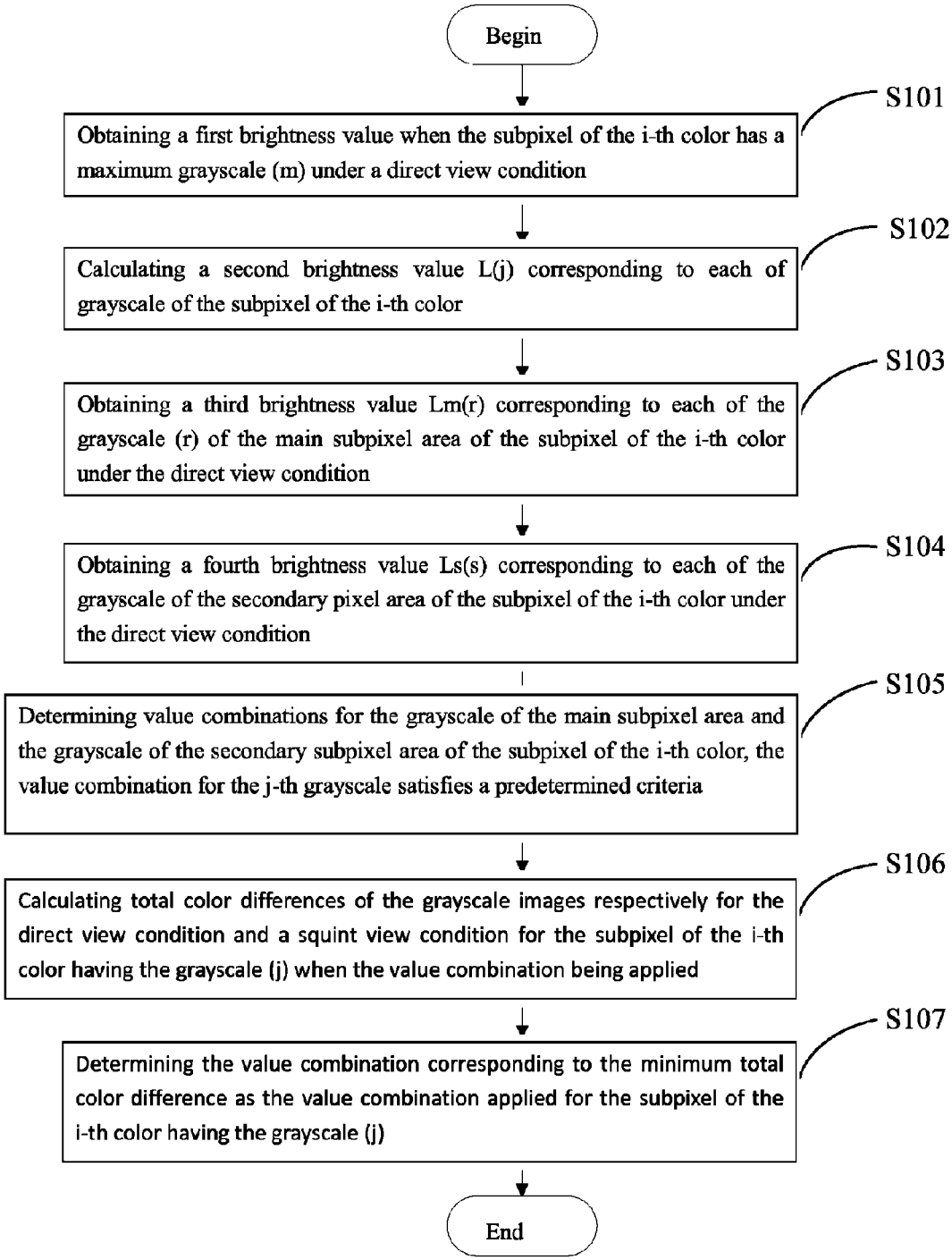
FIG. 1 is a flowchart illustrating a grayscale-correction method of subpixels of liquid crystal panel in accordance with one embodiment.
Figure 2:
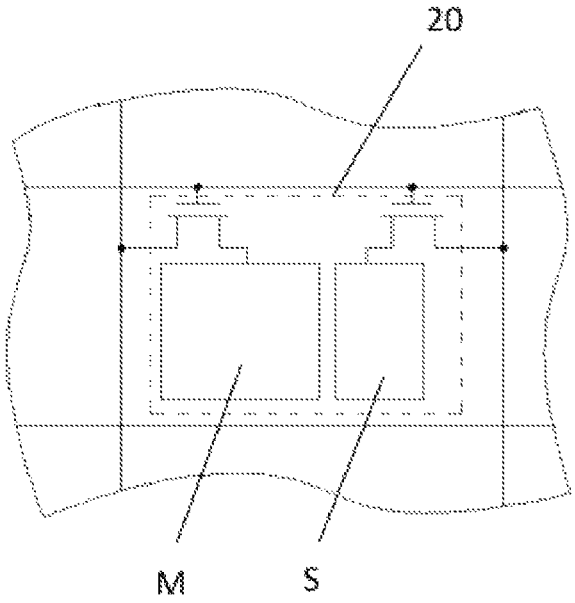
FIG. 2 is a schematic view of the subpixel of the conventional liquid crystal panel adopting 2D1G technology.

FIG. 1 is a flowchart illustrating a grayscale-correction method of subpixels of liquid crystal panel in accordance with one embodiment. The liquid crystal panel includes a plurality of pixels, and each of the pixels includes subpixels of n number of colors, wherein n is an integer larger than 0. In an example, the liquid crystal panel may be a RGB, RGBY, or RGBW liquid crystal panel. When the liquid crystal panel is the RGB liquid crystal panel, n equals to 3. When the liquid crystal panel is the RGBY liquid crystal panel or RGBW liquid crystal panel, n equals to 4.

As shown in FIG. 1, in block S101, a Gamma curve of i-th color among n numbers of colors is measured under a direct view so as to obtain a first brightness value when the subpixel of the i-th color has a maximum grayscale (m), wherein i∈[1, n]. The direct view relates to the scenario that there is 0 degree between a viewing angle and a direction perpendicular to the liquid crystal panel. The Gamma curve is a curve showing a relationship between the grayscale and the brightness. It can be understood that the Gamma curve may be measured by a variety of methods.

The number of grayscale levels may be variable in accordance with the liquid crystal panel. For instance, when the liquid crystal panel is the 8-bit liquid crystal panel, there are 256 levels for grayscale, and the grayscale may be presented as 0, 1, 2, . . . , and 255. At this moment, the maximum grayscale (m) is 255, and the minimum grayscale is 0. When the liquid crystal panel is the 10-bit liquid crystal panel, there are 1024 levels for grayscale, and the grayscale may be presented as 0, 1, 2, . . . , and 1023. At this moment, the maximum grayscale (m) is 1023, and the minimum grayscale is 0.

In block S102, a second brightness value L(j) corresponding to each of the i-th grayscale of the subpixel of the i-th color is calculated in accordance with the first brightness value obtained in block S101 and a predetermined Gamma value, wherein j∈[t, m], t represents the minimum grayscale. In an example, the second brightness value L(j) may be calculated by the equation below.

$$L(j)=L(m)\times(j/m)^{\gamma} \quad (1)$$

Wherein r represents a predetermined Gamma value, and L(m) represents the first brightness value when the subpixel of the i-th color has a maximum grayscale (m). The predetermined may be determined by a best display performance of the liquid crystal panel. Preferably, the predetermined Gamma value is 2.2. The second brightness value L(j) changes in accordance with the change of the grayscale "j".

In block S103, a third brightness value Lm(r) corresponding to r-th grayscale of the main subpixel area of the i-th color is calculated under the direct view condition, wherein r∈[t, m]. The third brightness value Lm (r) may be obtained by a variety of methods. Preferably, the third brightness value Lm(r) may be obtained by the following steps. First the secondary subpixel area of the subpixel of the i-th color may be turned off, which may be achieved by a variety of conventional method.

Afterward, the Gamma curve of the i-th color of the liquid crystal panel is measured under the direct view condition so as to obtain the third brightness value Lm (R) corresponding to the r-th grayscale of the main subpixel area of the i-th color. It can be understood that the Gamma curve may be measured by a variety of methods. The third brightness value Lm(r) may be variable in accordance with the grayscale (r).

In block S104, under the direct view condition, a fourth brightness value Ls(s) corresponding to the s-th grayscale of the secondary pixel area of the i-th color is obtained, wherein s∈[t, m]. The fourth brightness value Ls(s) may be obtained by a variety of methods. Preferably, the fourth brightness value Ls(s) may be obtained by the following steps.

First, the main subpixel area of the subpixel of the i-th color may be turned off, which may be achieved by a variety of methods.

Afterward, the Gamma curve of the i-th color of the liquid crystal panel is measured under the direct view condition so as to obtain the fourth brightness value Ls(s) corresponding to the s-th grayscale of the secondary subpixel area of the subpixels of the i-th color. It can be understood that the Gamma curve may be measured by a variety of methods. The fourth brightness value Ls(s) may be variable in accordance with the grayscale (r).

In block S105, basing on the second brightness value L(j) obtained by block S102, the value combination of the grayscale (r) and (s) with respect to grayscale (j) satisfying equation (2) is determined. The predetermined criteria are shown as the equation below.

$$[Lm(r)+Ls(s)-L(j)]/L(j)<S \quad (2)$$

S is one predetermined value, and may be configured in accordance with the characteristic of the liquid crystal panel.

In other words, in blocks S105, all of the value combinations of the grayscale (r) and (s) with respect to grayscale (j) satisfying equation (2) are determined, and the value combinations are candidate value combinations for the subpixel of the i-th color to be shown as having the grayscale (j).

In block S106, the total color difference of the subpixel of the i-th color having the grayscale (j) under the direct view condition and the squint view condition is determined when each of the value combination is applied. That is, the grayscale of the main subpixel area and the grayscale of the secondary subpixel area of the subpixel of the i-th color are configured to be the grayscale of each of the value combinations so as to show the grayscale (j) under different value combination. The squint view relates to the scenario that there is a predetermined angle between a viewing angle and a direction perpendicular to the liquid crystal panel.

The predetermined angel may be in a range between 0 and 90. Preferably, the predetermined angle is 60 degrees.

Total color difference may be determined by a variety of methods. Preferably, the step of obtaining any one of the value combinations for which the subpixel of i-th color has the grayscale (j) under the direct view and the squint view may include the following steps.

First, tristimulus values respectively for the direct view condition and squint view condition are obtained with respect to any one of the value combination, wherein the subpixel of the i-th color has the grayscale (j). The tristimulus value may be obtained by a variety of methods.

Second, psychrometric lightness and psychrometric chromaticity are calculated basing on the tristimulus values under the direct view condition. In addition, the psychrometric lightness and psychrometric chromaticity are calculated basing on the tristimulus values under the condition of squint view. The psychrometric lightness and psychrometric chromaticity may be calculated by a variety of methods.

Basing on the psychrometric lightness and psychrometric chromaticity respectively for the direct view condition and the squint view condition, the total color difference of the grayscale images may be calculated respectively for the direct view condition and the squint view condition. The total color difference may be calculated by a variety of methods.

In an example, the total color difference may be calculated in accordance with the color space system "CIE1976".

It can be understood that the step of determining the total color difference, in block S105, may determine the value combination of the grayscale (r) and (s) such that when the subpixel of the i-th color to be shown as having the grayscale (j).

In block S107, determining the value combination corresponding to the minimum total color difference as the value combination applied for the subpixel of the i-th color having the grayscale (j). That is, the value combination is determined as the value combination of the grayscale (r) and (s) with respect to grayscale (j) obtained in block S105.

In the embodiments, the value combinations of the grayscale (r) of the main subpixel area and the grayscale (s) of the secondary subpixel area corresponding to each of the grayscale (j) of the subpixel of the i-th color may be determined in block S105-S107, wherein j is within [t, m]. Thus, the value combinations of the grayscale (r) of the main subpixel area and the grayscale (s) of the secondary subpixel area corresponding to each of the grayscale (j) of the subpixel of the i-th color may be determined in block S101-S107, wherein i is within [1, n] and j is within [t, m].

It can be understood that the sequence of the above blocks of the method of grayscale calibration of subpixels of liquid crystal panels during imaging may be adjusted accordingly.

Figure 3:
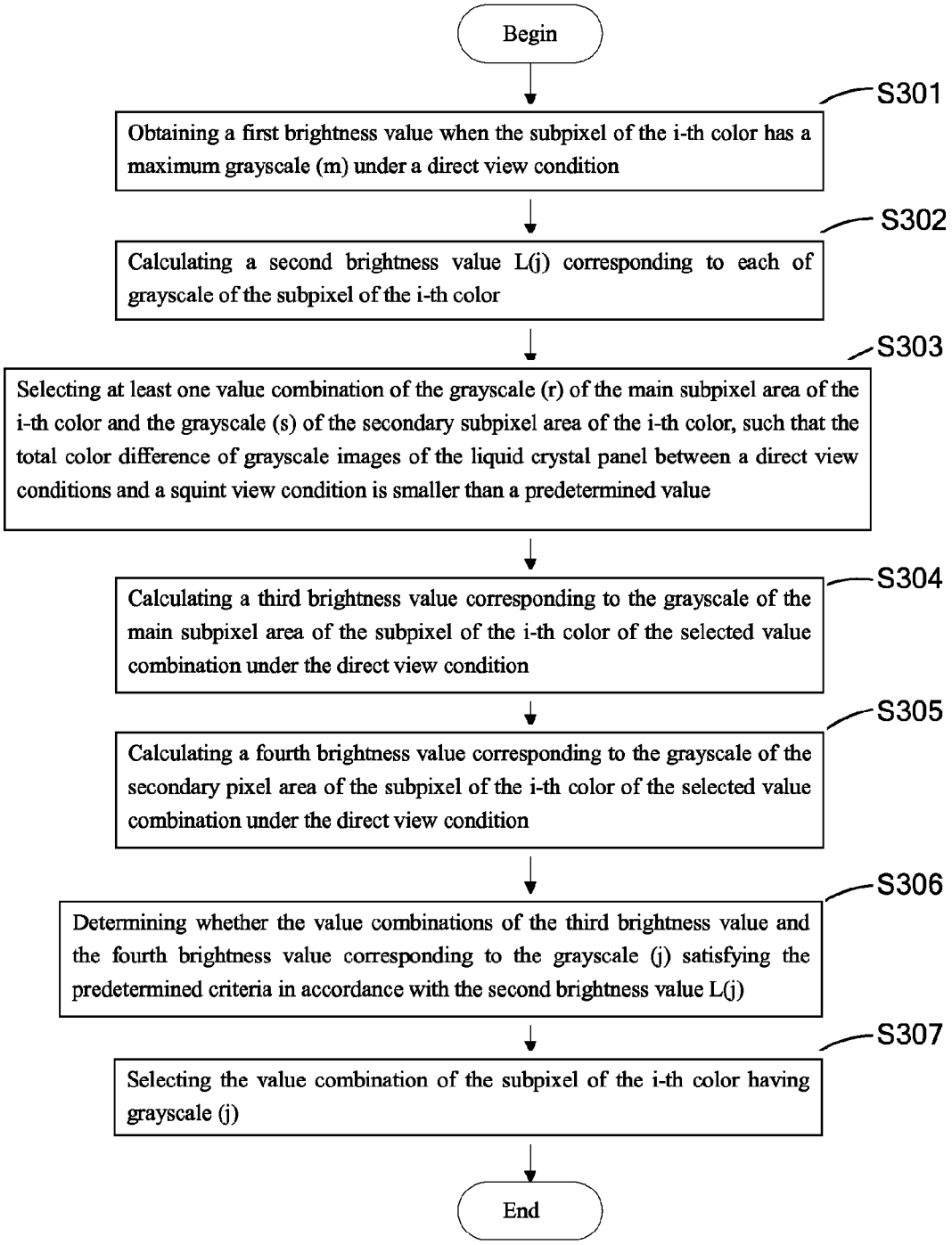
FIG. 3 is a flowchart illustrating a grayscale-correction method of subpixels of liquid crystal panel in accordance with another embodiment.

FIG. 3 is a flowchart illustrating a grayscale-correction method of subpixels of liquid crystal panel in accordance with another embodiment. The liquid crystal panel includes a plurality of pixels, and each of the pixels includes subpixels of n number of colors, wherein n is an integer larger than 0. Each of the subpixels may include a main subpixel area and a secondary subpixel area. In an example, the liquid crystal panel may be a RGB, RGBY, or RGBW liquid crystal panel. When the liquid crystal panel is the RGB liquid crystal panel, n equals to 3. When the liquid crystal panel is the RGBY liquid crystal panel or RGBW liquid crystal panel, n equals to 4.

As shown in FIG. 3, in block S301, a Gamma curve of i-th color among n numbers of colors is measured in a direct view so as to obtain a first brightness value when the subpixel of the i-th color has a maximum grayscale (m), wherein i∈[1, n]. The direct view relates to the scenario that there is 0 degree between a viewing angle and a direction perpendicular to the liquid crystal panel. The Gamma curve is a curve showing a relationship between the grayscale and the brightness. It can be understood that the Gamma curve may be measured by a variety of methods.

The number of grayscale levels may be variable in accordance with the liquid crystal panel. For instance, when the liquid crystal panel is the 8-bit liquid crystal panel, there are 256 levels for grayscale, and the grayscale may be presented as 0, 1, 2, . . . , and 255. At this moment, the maximum grayscale (m) is 255, and the minimum grayscale is 0. When the liquid crystal panel is the 10-bit liquid crystal panel, there are 1024 levels for grayscale, and the grayscale may be presented as 0, 1, 2, . . . , and 1023. At this moment, the maximum grayscale (m) is 1023, and the minimum grayscale is 0.

In block S302, a second brightness value L(j) corresponding to grayscale of the subpixel of the n-th color is calculated in accordance with the first brightness value obtained in block S101 and a predetermined Gamma value, wherein j∈[t, m], t represents the minimum grayscale. In an example, the second brightness value L(j) may be calculated by the equation below.

$$L(j)=L(m)\times(j/m)^{\gamma} \quad (3)$$

Wherein r represents a predetermined Gamma value, and L(m) represents the first brightness value when the subpixel of the i-th color has a maximum grayscale (m). The predetermined may be determined by a best display performance of the liquid crystal panel. Preferably, the predetermined Gamma value is 2.2. The second brightness value L(j) changes in accordance with the change of the grayscale "j".

In block S303, at least one value combination is determined, wherein the grayscale (r) of the main subpixel area of the i-th color and the grayscale (s) of the secondary subpixel area of the i-th color are selected such that the total color difference of grayscale images between the direct view condition and the squint view condition is smaller than a predetermined value, and r∈[t, m] 's∑[t, m]. In an example, the value combinations of the grayscale (r) of the main subpixel area of the i-th color and the grayscale (s) of the secondary subpixel area of the i-th color may be shown as {(r's)|r∈[t, m] 's∈[t, m]}. The squint view relates to the scenario that there is a predetermined angle between a viewing angle and a direction perpendicular to the liquid crystal panel. The predetermine angle may be an angle larger than zero degree and smaller than 90 degrees. Preferably, the predetermined angle is 60 degrees, and may be configured in accordance with the characteristics of the liquid crystal panel.

Specifically, the total color difference of grayscale images between the direct view condition and the squint view condition is obtained in block S303, wherein the grayscale (r) of the main subpixel area of the i-th color and the grayscale (s) of the secondary subpixel area of the i-th color are selected. Afterward, the value combinations for which the total color difference of grayscale images between the direct view condition and the squint view condition is smaller than the predetermined value are determined.

It is to be noted that the total color difference may be obtained by a variety of methods. The step of obtaining any one of the value combinations of the grayscale (r) of the main subpixel area of the i-th color and the grayscale (s) of the secondary subpixel area of the i-th color may include the following steps.

First, tristimulus values respectively for the direct view condition and the squint view condition are obtained with respect to any one of the value combination. The tristimulus value may be obtained by a variety of methods.

Second, psychrometric lightness and psychrometric chromaticity are calculated basing on the tristimulus under the condition of direct view. In addition, the psychrometric lightness and psychrometric chromaticity are calculated basing on the tristimulus under the condition of squint view. The psychrometric lightness and psychrometric chromaticity may be calculated by a variety of methods.

Basing on the psychrometric lightness and psychrometric chromaticity respectively for the direct view condition and the squint view condition, the total color difference of the grayscale images may be calculated respectively for the direct view condition and the squint view condition. The total color difference may be calculated by a variety of methods.

In an example, the total color difference may be calculated in accordance with the color space system "CIE1976".

It can be understood that the step of obtaining the total color difference relates to obtaining the total color difference for each of the value combinations, wherein the grayscale (r) of the main subpixel area of the i-th color and the grayscale (s) of the secondary subpixel area of the i-th color are selected.

Afterward, each of the obtained total color differences is compared with the predetermined value. The value combinations having the total color difference smaller than the predetermined value are determined.

In block S304, a third brightness value corresponding to the grayscale of the main subpixel area of the subpixel of the i-th color of the selected value combination is calculated under the direct view condition. The third brightness value may be obtained by a variety of methods. Preferably, the third brightness value may be obtained by the following steps.

First, the secondary subpixel area of the subpixel of the i-th color may be turned off, which may be achieved by a variety of conventional method.

Afterward, the Gamma curve of the i-th color of the liquid crystal panel is measured under the direct view condition so as to obtain the third brightness value corresponding to the grayscale of the main subpixel area of the i-th color. It can be understood that the Gamma curve may be measured by a variety of methods.

In block S305, under the direct view condition, a fourth brightness value corresponding to the grayscale of the secondary pixel area of the subpixel of the i-th color is obtained. The fourth brightness value may be obtained by a variety of methods. Preferably, the fourth brightness value may be obtained by the following steps.

First the main subpixel area of the subpixel of the i-th color may be turned off, which may be achieved by a variety of methods.

Afterward, the Gamma curve of the i-th color of the liquid crystal panel is measured under the direct view condition so as to obtain the fourth brightness value corresponding to the grayscale of the secondary subpixel area of the i-th color. It can be understood that the Gamma curve may be measured by a variety of methods.

In block S306, basing on the second brightness value L(j), a determination is made regarding whether the value combinations of the third brightness value and the fourth brightness value corresponding to the grayscale (j) satisfying the predetermined criteria. The predetermined criteria are selected such that the equation below owns the minimum value.

$$[Lm(x)+Ls(y)-L(j)]/L(j)$$

The Lm(x) relates to the third brightness value corresponding to the grayscale (x) of the main subpixel area of the value combination, and Ls(y) relates to the fourth brightness value corresponding to the grayscale (y) of the secondary subpixel area of the value combination.

In other words, the object of the block S306 is to determine the value combination for which owns the minimum value of the equation below for grayscale (j).

$$[Lm(x)+Ls(y)-L(j)]/L(j);$$

In blocks S307, determining the value combination corresponding to the minimum total color difference as the value combination applied for the subpixel of the i-th color having the grayscale (j).

In the embodiments, the value combinations of the grayscale (r) of the main subpixel area and the grayscale (s) of the secondary subpixel area corresponding to each of the grayscale (j) of the subpixel of the i-th color may be determined in block S305-S307, wherein j is within [t, m]. Thus, the value combinations of the grayscale (r) of the main subpixel area and the grayscale (s) of the secondary subpixel area corresponding to each of the grayscale (j) of the subpixel of the i-th color may be determined in block S301-S307, wherein i is within [1, n] and j is within [t, m].

It can be understood that the sequence of the above blocks of the method of grayscale calibration of subpixels of liquid crystal panels during imaging of FIG. 3 may be adjusted accordingly.

In view of the above, the method of grayscale calibration of subpixels of liquid crystal panels during imaging is capable of calibrating the grayscale of the subpixel during imaging so as to reduce the color shift issue when displaying images.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A method of grayscale calibration of subpixels of liquid crystal panels during imaging, each of the pixels of the liquid crystal panel comprises a plurality of subpixels of n number of colors, wherein n is an integer larger than 0, each of the subpixels comprises a main subpixel area and a secondary subpixel area, the method comprising:

(a) measuring a Gamma curve of i-th color among n numbers of colors under a direct view condition to obtain a first brightness value when the subpixel of the i-th color has a maximum grayscale (m), wherein i∈[1, n];

(b) calculating a second brightness value L(j) corresponding to each of grayscale of the subpixel of the i-th color in accordance with the first brightness value and a predetermined Gamma value, wherein j∈[t, m], t representing a minimum grayscale;

(c) obtaining a third brightness value Lm(r) corresponding to each of the grayscale (r) of the main subpixel area of the subpixel of the i-th color is calculated under the direct view condition, wherein r∈[t, m];

(d) obtaining a fourth brightness value Ls(s) corresponding to each of the grayscale of the secondary pixel area of the subpixel of the i-th color under the direct view condition, wherein s∈[t, m];

(e) determining value combinations for the grayscale of the main subpixel area and the grayscale of the secondary subpixel area of the subpixel of the i-th color basing on the second brightness value L(j), and the third brightness value Lm(r) and the fourth brightness value Ls(s) corresponding to the j-th grayscale satisfying a predetermined criteria;

(f) calculating total color differences of the grayscale images respectively for the direct view condition and a squint view condition for the subpixel of the i-th color having the grayscale (j) when the value combination being applied; and (g) determining the value combination corresponding to the minimum total color difference as the value combination applied for the subpixel of the i-th color having the grayscale (j).

2. The method as claimed in claim 1, wherein the step (f) further comprises:

(f1) obtaining tristimulus values of grayscale images displayed by the liquid crystal panel respectively when applying one of the value combination under a direct view condition and a squint view condition, wherein the subpixel of the i-th color having the grayscale (j);

(f2) calculating psychrometric lightness and psychrometric chromaticity in accordance with the tristimulus values under the direct view condition, and calculating psychrometric lightness and psychrometric chromaticity in accordance with the tristimulus values under the squint view condition; and (f3) calculating the total color difference of the grayscale images respectively for the direct view condition and the squint view condition in accordance with the psychrometric lightness and psychrometric chromaticity under the direct view condition and the squint view condition.

3. The method as claimed in claim 1, wherein the step (b) further comprises:

calculating the second brightness value L(j) corresponding to each of the grayscale (j) of the subpixel of the i-th color in accordance with the first brightness value and the predetermined Gamma value by the equation:

$$L(j)=L(m)\times(j/m)^{\gamma};$$

wherein γ represents a predetermined Gamma value, and L(m) represents the first brightness value when the subpixel of the i-th color has a maximum grayscale (m).

4. The method as claimed in claim 1, wherein the step (c) further comprises:

turning off the secondary subpixel area of the subpixel of the i-th color;

measuring the Gamma curve of the i-th color of the liquid crystal panel under the direct view condition so as to obtain the third brightness value Lm (R) corresponding to the r-th grayscale of the main subpixel area of the subpixels of the i-th color;

and the step (d) further comprises:

turning off the main subpixel area of the subpixel of the i-th color; and measuring the Gamma curve of the i-th color of the liquid crystal panel under the direct view condition so as to obtain the fourth brightness value Ls(s) corresponding to the s-th grayscale of the secondary subpixel area of the subpixels of the i-th color.

5. The method as claimed in claim 1, wherein the predetermined criteria of the step (e) is:

$$[Lm(r)+Ls(s)-L(j)]/L(j)<S;$$

wherein S is the predetermined value.

6. A method of grayscale calibration of subpixels of liquid crystal panels during imaging, each of the pixels of the liquid crystal panel comprises a plurality of subpixels of n number of colors, wherein n is an integer larger than 0, each of the subpixels comprises a main subpixel area and a secondary subpixel area, the method comprising:

(a) measuring a Gamma curve of i-th color among n numbers of colors under a direct view condition to obtain a first brightness value when the subpixel of the i-th color has a maximum grayscale (m), wherein $i \in [1, n]$;

(b) calculating a second brightness value L(j) corresponding to each of grayscale of the subpixel of the i-th color in accordance with the first brightness value and a predetermined Gamma value, wherein $j \in [t, m]$, t representing a minimum grayscale;

(c) selecting at least one value combination of the grayscale (r) of the main subpixel area of the i-th color and the grayscale (s) of the secondary subpixel area of the i-th color, such that the total color difference of grayscale images of the liquid crystal panel between a direct view conditions and a squint view condition is smaller than a predetermined value, and $r \in [t, m]$, $s \in [t, m]$;

(d) calculating a third brightness value corresponding to the grayscale of the main subpixel area of the subpixel of the i-th color of the selected value combination under the direct view condition;

(e) calculating a fourth brightness value corresponding to the grayscale of the secondary pixel area of the subpixel of the i-th color of the selected value combination under the direct view condition;

(f) determining whether the value combinations of the third brightness value and the fourth brightness value corresponding to the grayscale (j) satisfying the predetermined criteria in accordance with the second brightness value L(j); and (g) selecting the value combination of the subpixel of the i-th color having grayscale (j).

7. The method as claimed in claim 6, wherein the step (c) further comprises:

(c1) obtaining tristimulus values of grayscale images displayed by the liquid crystal panel respectively for a direct view condition and a squint view condition;

(c2) calculating psychrometric lightness and psychrometric chromaticity in accordance with the tristimulus values under the direct view condition, and calculating psychrometric lightness and psychrometric chromaticity in accordance with the tristimulus values under the squint view condition; and (c3) calculating a total color difference of the grayscale images of the liquid crystal panel respectively for the direct view condition and the squint view condition in accordance with the psychrometric lightness and psychrometric chromaticity under the direct view condition and the squint view condition.

8. The method as claimed in claim 6, wherein the step (b) further comprises:

calculating the second brightness value L(j) corresponding to each of the grayscale (j) of the subpixel of the i-th color in accordance with the first brightness value and the predetermined Gamma value by the equation:

$$L(j)=L(m)\times(j/m)^{\gamma};$$

wherein γ represents a predetermined Gamma value, and L(m) represents the first brightness value when the subpixel of the i-th color has a maximum grayscale (m).

9. The method as claimed in claim 6, wherein the step (d) further comprises:

turning off the secondary subpixel area of the subpixel of the i-th color;

measuring the Gamma curve of the i-th color of the liquid crystal panel under the direct view condition so as to obtain the third brightness value corresponding to the grayscale of the main subpixel area of the subpixels of the i-th color of the selected value combination;

wherein the step (e) further comprises:

turning off the main subpixel area of the subpixel of the i-th color; and measuring the Gamma curve of the i-th color of the liquid crystal panel under the direct view condition so as to obtain the fourth brightness value corresponding to the grayscale of the secondary subpixel area of the subpixels of the i-th color of the selected value combination.

10. The method as claimed in claim 6, wherein the predetermined criteria is selected such that the equation below owns the minimum value:

$$[Lm(x)+Ls(y)-L(j)]/L(j);$$

wherein Lm(x) represents a third brightness value corresponding to the grayscale (x) of the main subpixel area of the value combination, and Ls(y) represents a fourth brightness value corresponding to the grayscale (y) of the secondary subpixel area of the value combination.

* * * * *